United States Patent [19]

Cox

[11] Patent Number: 4,666,670

[45] Date of Patent: May 19, 1987

[54] POTPOURRI HOLDER FOR CEILING FAN

[76] Inventor: Mary P. Cox, 2401 Cornell Dr., Roswell, N. Mex. 88201

[21] Appl. No.: 803,436

[22] Filed: Dec. 2, 1985

[51] Int. Cl.[4] ..... A62B 11/00

[52] U.S. Cl. ..... 422/124; 416/5

[58] Field of Search ..... 416/5; 422/123, 124

[56] References Cited

U.S. PATENT DOCUMENTS

| | | | |
|---|---|---|---|
| 1,246,529 | 11/1917 | Bieder | 422/124 |
| 1,439,881 | 12/1922 | Fontaine | 422/124 |
| 1,528,640 | 3/1925 | Tvrzicky et al. | 422/124 |
| 1,911,871 | 5/1933 | Andersen | 422/124 |
| 1,977,760 | 10/1934 | Freestone | 422/124 |
| 2,136,254 | 11/1938 | Sargent | 422/124 |

FOREIGN PATENT DOCUMENTS

| | | | |
|---|---|---|---|
| 62907 | 7/1913 | Austria | 422/124 |

*Primary Examiner*—Harold Joyce

*Attorney, Agent, or Firm*—Harvey B. Jacobson

[57] ABSTRACT

A basket containing perfumed potpourri is suspended beneath a ceiling fan so that air from the fan is circulated through the basket and perfumed by the potpourri. The basket has a bottom portion of relatively tightly formed mesh for retaining the potpourri and an upper portion of relatively loosely formed mesh for providing air circulation through the basket.

10 Claims, 3 Drawing Figures

POTPOURRI HOLDER FOR CEILING FAN

BACKGROUND OF THE INVENTION

This invention relates to an attachment for a ceiling fan for perfuming the air in a room in which the fan is used.

"Casablanca" style ceiling fans are currently in vogue and commonly in use. Such fans are suspended from a ceiling electrical outlet and are commonly provided with a depending light bulb housing. The fans have relatively large, relatively slow-speed vanes and are effective in creating an axial down draft for cooling a room in which they are used. It is an object of the invention to provide an attachment for a ceiling fan which utilizes the down draft of the fan to perfume the air in the room.

SUMMARY OF THE INVENTION

In accordance with the invention, there is provided a bowl-shaped mesh basket for suspension from the bottom of a ceiling fan, preferably from a light bulb housing at the base of the fan, the basket having a bottom portion of relatively tightly formed mesh for retention of potpourri therein as a source of perfume scents, and an upper portion of relatively loosely formed mesh of maximum porosity for circulation of air from the fan through the basket, the upper portion terminating in a neck opening for insertion of potpourri, and attachment means associated with the neck opening for securing the basket to a fan associated fixture housing in close axially spaced relation to the fan blades.

The basket can be made in a variety of known basket materials such as wicker, straw or plastic, and may be made by any known basket-making technique. A variety of attachment means may be used for securing the basket to the fan, such as radial screw fittings, or resilient basket strands formed across the opening and which can be resiliently spread apart for pressing the basket from below onto a light bulb or lamp fixture housing of the fan, for example, In use, the relatively loosely woven upper porous portion of the basket allows air from the fan to circulate through the basket over the potpourri, held in a less porous portion of the basket thereby perfuming the air.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
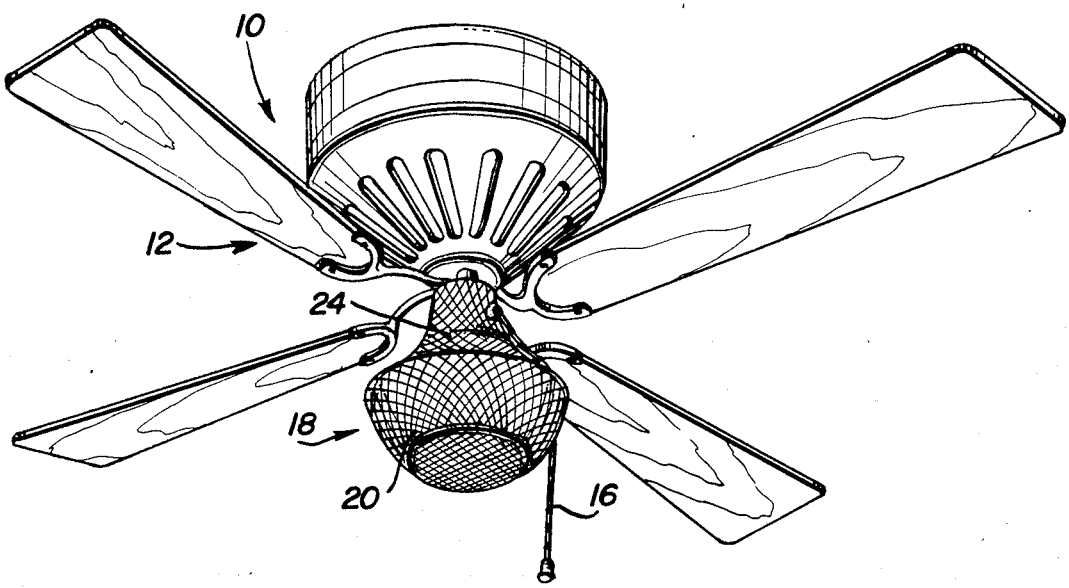
FIG. 1 is a perspective view of a ceiling fan fitted with a potpourri basket in accordance with the invention.
Figure 2:
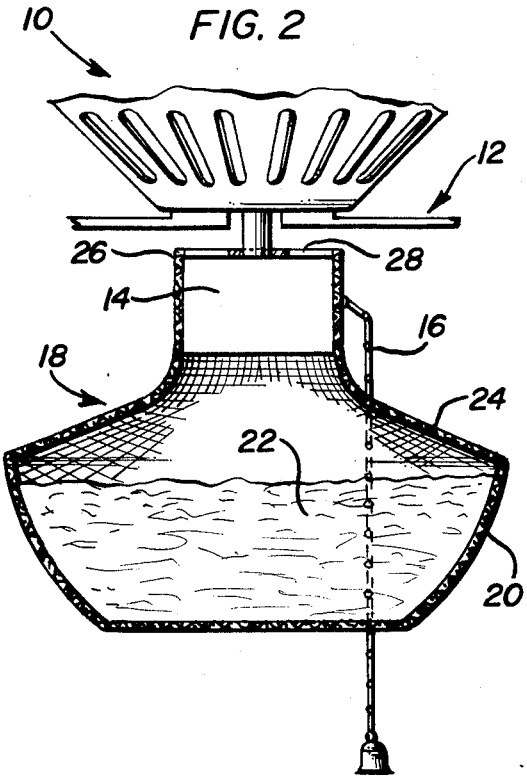
FIG. 2 is an enlarged cross sectional view of the apparatus.
Figure 3:
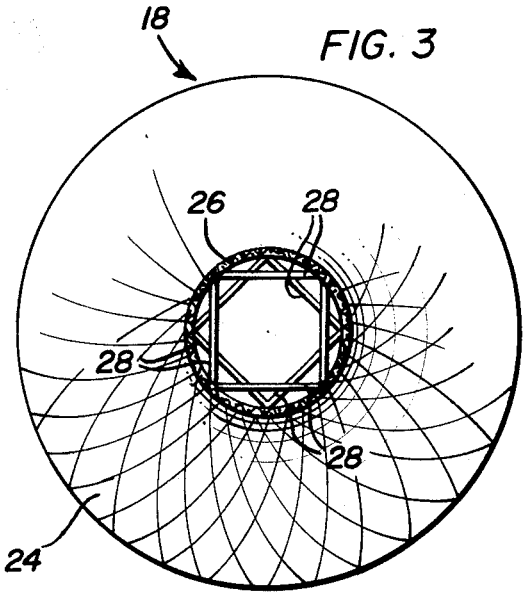
FIG. 3 is a plan view of the basket.

A "Casablanca" style ceiling fan 10 is shown suspended in known manner from a ceiling electrical outlet (not shown), the fan having an electrically driven vaned rotor 12 for providing an air circulation axial down draft, and a fixture such as a light bulb housing 14 at the base of the fan closely spaced below the fan blades as shown from which a switch chain 16 extends for controlling the rotor and a light bulb (not shown) in housing 14. A potpourri basket 18 is secured to housing 14 in accordance with the invention.

Basket 18 may be made of straw, wicker, plastic or other mesh, and may be manufactured by weaving, knitting, or any other known basket-making technique. The basket has a bowl-shaped bottom portion 20 in which the meshes are relatively tightly knit, woven or otherwise formed, in order to retain flake-type perfumed potpourri 22 therein, and an upper portion 24 converging toward a neck opening 26 and in which the meshes are less tightly formed, so as to allow air from the fan to circulate through the basket over the potpourri, thereby perfuming the air.

Across neck opening 26 there are provided a number of crossing basket meshes 28 which can be resiliently spread apart for pushing the basket from below onto housing 14, and which meshes serve as attachment means for retaining the basket on the fan. Other forms of attachment means, however, can be used. Chain 16 may be let out through one of the mesh openings in upper portion 24 of the basket. As required, the basket can be removed and the potpourri can be replenished through opening 26.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A basket for attachment to a fan assembly having rotor blades and a fixture in close axially spaced relation thereto, the basket having a bowl-shaped bottom portion, and an upper portion which terminates in a neck opening, the bottom portion being made of relatively tightly formed mesh for the retention of perfumed potpourri therein, the upper portion being made of relatively loosely formed mesh for the circulation of air through the basket, and the neck opening having attachment means for suspending the basket from said fixture associated with the fan assembly.

2. The invention of claim 1 wherein the upper portion of the basket converges toward the neck opening.

3. The invention of claim 1 wherein the attachment means comprises basket meshes extending across the neck opening for being resiliently spread apart to attach the basket from below to the housing portion and for then fitting over the top of the housing portion to retain the basket thereon.

4. In combination with a rotary fan assembly having fan blades and a fixture housing portion in close axially spaced relation thereto, a basket suspended below said housing portion of the fan assembly, the basket having a bowl-shaped bottom portion with relatively small mesh openings for the retention of perfumed potpourri therein, and an upper portion having relatively larger mesh openings terminating in a neck opening for circulation of air from the fan blades through the basket.

5. The invention of claim 4 wherein the neck opening of the basket has attachment means securing the basket to the housing portion of the fan assembly.

6. The invention of claim 5 wherein the attachment means comprises basket meshes extending across the opening over the housing portion of the fan assembly.

7. The invention of claim 4 wherein the upper portion of the basket converges toward the neck opening.

8. In combination, a source of perfume type scents, a fan assembly having rotatable blades and a fixture in close axially spaced relation thereto, and container means for holding said source of scents in operative relation to the blades, the improvement comprising means for mounting the container means exclusively on the fixture, and said container means including a first porous portion extending axially from the fixture into which airflow is induced by rotation of the blades and a second portion of lower porosity relative to the first porous portion, within which the source is retained axially spaced from the blades by the first portion of the container means.

9. The improvement as defined in claim 8 wherein the second portion is connected to and diametrically larger than the first portion of the container means.

10. The combination of claim 9 wherein said fan assembly is of the ceiling type and said airflow induced by rotation of the blades is a cooling downdraft.

* * * * *